United States Patent [19]

Oda et al.

[11] Patent Number: 4,688,927

[45] Date of Patent: Aug. 25, 1987

[54] ELECTROPHOTOGRAPHIC COPYING MACHINE

[75] Inventors: Masataka Oda; Tsugihito Yoshiyama; Hisashi Myochin, all of Toyohashi; Kouji Matsushita, Toyokawa, all of Japan

[73] Assignee: Minolta Camera Kabushiki Kaisha, Osaka, Japan

[21] Appl. No.: 813,572

[22] Filed: Dec. 26, 1985

[30] Foreign Application Priority Data

Dec. 27, 1984 [JP] Japan ..... 59-275688

[51] Int. Cl.[4] ..... G03G 15/00

[52] U.S. Cl. ..... 355/3 TR; 355/3 CH; 355/3 SH; 355/14 TR; 355/14 CH

[58] Field of Search ..... 355/3 TR, 14 TR, 3 R, 355/14 R, 153 CH, 35 H; 430/53

[56] References Cited

U.S. PATENT DOCUMENTS

| | | | |
|---|---|---|---|
| 3,819,262 | 6/1974 | Estandarte | 355/15 |
| 4,039,257 | 8/1977 | Connolly | 355/14 TR X |
| 4,076,407 | 2/1978 | Place, Jr. | 355/14 TR |
| 4,184,870 | 1/1980 | Suzuki | 430/53 |
| 4,338,017 | 7/1982 | Nishikawa | 355/3 TR |
| 4,402,591 | 9/1983 | Nakahata | 355/14 TR X |

FOREIGN PATENT DOCUMENTS 53-106049 2/1977 Japan .

*Primary Examiner*—A. C. Prescott

*Attorney, Agent, or Firm*—Watson Cole Grindle & Watson

[57] ABSTRACT

An electrophotographic copying machine capable of producing successively a plurality of identical copies from one electrostatic latent image formed on a photoreceptor carrier, which machine comprises a charge eraser for preventing an electrostatic discharge from ocurring between the photoreceptor drum and a copying paper at a starting point of separation where the copying paper separates from the photoreceptor carrier after a toner image has been transferred onto the copying paper. The charge eraser is arranged so as to confront the separation point.

8 Claims, 15 Drawing Figures

ELECTROPHOTOGRAPHIC COPYING MACHINE

BACKGROUND OF THE INVENTION

The present invention generally relates to an electrophotographic copying machine having a capability of successively producing a plurality of identical copies from one and the same electrostatic latent image formed on a photoreceptor carrier.

In an electrophotographic copying process, it is generally known that, at the time a copying paper is forcibly separated from the photoreceptor carrier after the transfer of a toner image from the electrostatic latent image on the photoreceptor carrier onto the copying paper, a pattern of charge is formed on the photoreceptor drum as a result of the occurrence of electrostatic discharge from a transfer means through the copying paper. For the description herein set forth this type of electrostatic discharge is referred to as "separation discharge".

The occurrence of the separation discharge will be discussed in detail with reference to FIG. 10. As shown therein, at the time the toner image formed on a photoconductive medium 1 is to be transferred onto the copying paper 2, charge opposite in polarity to the toner particles is applied by a DC transfer charger 3 to the copying paper 2. When the electrostatic force of the copying paper tending to attract the toner particles overcomes the electrostatic force of the photoconductive medium 1 retaining the toner particles in the form of the toner image, the toner image can be transferred onto the copying paper 2. It is to be noted that, in FIG. 10, the electrostatic charge of the toner particles is assumed to be of positive polarity, the corona discharge produced by the DC transfer charger 3 is assumed to be of negative polarity, and the photoconductive medium 1 in the form of a rotary drum and the copying paper 2 are assumed to be moved in the respective directions shown by the arrows a and b.

The copying paper 2 is separated from the photoconductive medium 1 immediately after the transfer of the toner image onto the copying paper 2. At this time, an electrostatic force of attraction acts between the toner image and the copying paper by a high charge imparted by the DC transfer charger 3 and, in most cases, it is greater than a natural force of separation relying on the stiffness of the copying paper 2. According to the prior art, a forced separating means of, for example, a belt type or a claw type, and/or an AC charge eraser 4 operable to apply an AC corona discharge to the copying paper 2 to neutralize the charge built on the copying paper 2 have been employed.

As the copying paper 2 separates from the photoconductive medium 1, a gap formed therebetween progressively increases accompanied by an increase in potential difference therebetween. The separation discharge is attributable to the increased potential difference, and the result thereof is a disturbance of the electrostatic latent image formed on the photoconductive medium. In the worst case, the disturbed latent image brings about a disturbance of an image area, and even though it may not occur, a background area tends to be disturbed because the potential at the background area is lower than that at the image area to be susceptible to discharge.

In an electrophotographic copying machine wherein one electrostatic latent image is used for one copy to be made, the latent image is formed each time the toner image has been transferred onto a copying paper. In such machine, the disturbance of the electrostatic latent image such as hereinabove discussed need not be taken into consideration. However, in the case of a similar copying machine having a capability of operating under a "retention copy mode" wherein one and the same electrostatic latent image is used for the successive production of a plurality of identical copies, the disturbance of the once-formed electrostatic latent image poses a serious problem in that the copies, except for the first one, will bear a distorted, unclear, and/or spoiled reproduced image.

SUMMARY OF THE INVENTION

Accordingly, the present invention has been developed with a view to substantially eliminating the above discussed disadvantages and inconveniences inherent in the prior art and has for its essential object to provide an improved electrophotographic copying machine having a capability of operating under the retention copy mode, wherein the above-discussed disadvantages and inconveniences can be substantially eliminated by providing it with means for preventing an electrostatic charge or a separation discharge from occurring between the photoconductive medium and the copying paper at a starting point of separation of the copying paper from the photoconductive medium.

Preferably, the preventing means is a charge eraser disposed so as to confront the starting point of such separation.

In any event, a technical idea of the present invention lies in the minimization of disturbance of the electrostatic latent image during the retention process, which is achieved by concentrating an AC charge erasing component on the starting point of separation during the separation of the copying paper from the drum to avoid the occurrence of the separation discharge.

BRIEF DESCRIPTION OF THE DRAWINGS

This and other objects and features of the present invention will become clear from the following description taken in conjunction with preferred embodiments with reference to the accompanying drawings, in which.

DETAILED DESCRIPTION OF THE EMBODIMENTS

Figure 1:
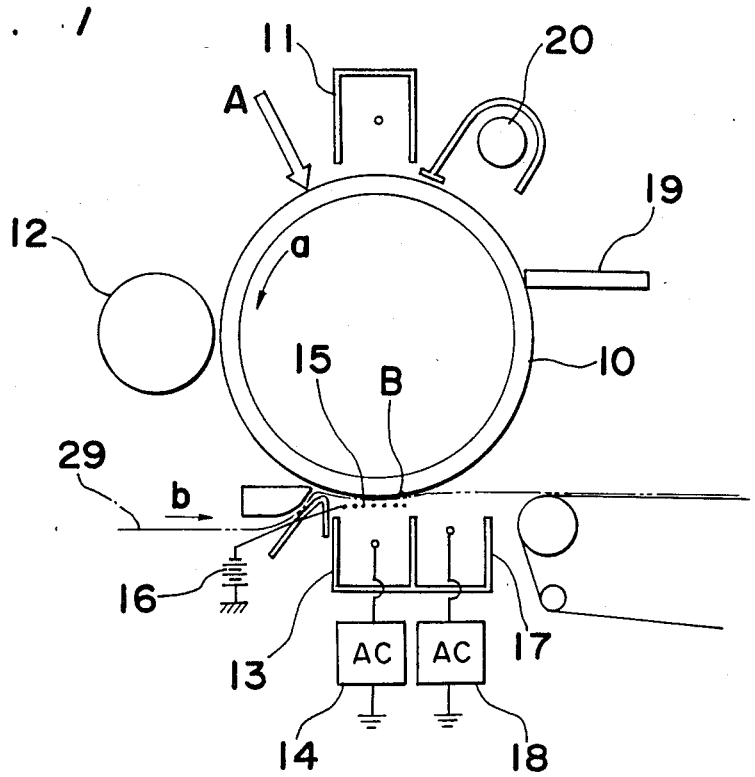
FIG. 1 is a schematic diagram showing a photoreceptor drum and peripheral parts of an electrophotographic copying machine according to a first embodiment of the present invention.

The present invention will now be described with reference to the accompanying drawings, in which like parts are designated by like reference numerals, in connection with illustrative examples which are not intended to limit the scope of the present invention.

EXAMPLE 1

For the purpose of the present invention, an electrophotographic copying machine was employed which comprises, as shown in FIG. 1, a photoreceptor drum 10 of any known construction supported for rotation in one direction, for example, counterclockwise as indicated by the arrow a, sequentially past a plurality of processing stations situated exteriorly of the outer periphery of the drum 10. These processing stations include a charging station at which an electrostatic charger 11 is disposed for depositing a uniform electrostatic charge on the photoconductive layer of the drum 10; an exposure station at which an imagewise light carrying an image to be copies is projected, as indicated by A, onto the photoconductive layer to dissipate the electrostatic charge in the exposed areas thereof thereby to form an electrostatic latent image; a developing station at which a magnetic brush developing unit 12 is disposed for applying a developer mix including toner particles having an electrostatic charge opposite in polarity to that of the electrostatic latent image, whereby the toner particles adhere to the electrostatic latent image to form a powder image in the configuration of the image to be copied on a copying paper 29; a transfer station at which a transfer charger 13 is disposed for permitting the powder image to be electrostatically transferred from the photoconductive layer onto the copying paper 29 then brought into face-to-face contact with that portion of the photoconductive layer which has carried the powder image; a separating station at which an AC charge eraser 17 is disposed for neutralizing the electrostatic charge built on the copying paper 29 for facilitating the separation of the copying paper 29, carrying the transferred powder image, from the photoconductive surface of the drum thereby to permit the copying paper to be conveyed towards a fixing station in a direction shown by the arrow b; a drum cleaning station at which a blade-type cleaning unit 19 is disposed for removing residual toner particles from the photoconductive layer of the drum; and a charge erasing station at which an eraser lamp 20 is disposed for irradiating the photoconductive layer to effect complete discharge of any residual electrostatic charge remaining thereon.

The transfer charger 14 and the AC charge eraser 17 are electrically connected with respective AC high voltage transformers 14 and 18.

The retention copy mode wherein one and the same electrostatic latent image is used for making a number of copies all bearing the identical image requires the copying machine to undergo a plurality of cycles of copying operation equal in number to the number of the copies desired. However, under the retention copying mode, the eraser lamp 20, the corona charger 11 and an exposure system, including an illuminator for illuminating an original having an image to be copied, are all brought into an inoperative position during the cyclical copying operations, except for the initial copying operation which requires them to be operated for the formation of the electrostatic latent image on the photoconductive layer of the drum 10 for the successive reproduction of the identical copies.

For the purpose of this Example, the transfer charger 13 was employed in the form of an AC SCOROTORON charger provided with grid electrodes 15 as a means for suppressing the generation of the separation discharge, that is, the generation of discharge occurring during the progressive separation of the copying paper from the photoconductive layer of the drum 10, thereby to avoid any possible disturbance of the electrostatic latent image formed during the initial copying operation, which electrodes 15 are electrically connected with a DC power source 16. Before the reason is described, the results of experiments conducted by the inventors of the present invention will first be described.

Experiment Conditions

Drum: 80 mm in diameter having a CdS photoconductive layer. Driven at a peripheral velocity of 1.3 cm/sec.
Charge potential: Approx. −600 V
Voltage applied to transfer charger: 6 KVrms
Voltage applied to AC charge eraser: 5.5 KVrms
Grid electrodes: Tungsten wires of 60 μm in diameter, spaced 2 mm from each other and 2 mm from the closest point of the drum periphery.
Copying paper: High quality paper of 64 g/m$^2$ Using the above described conditions and such varying voltage applied to the grid electrodes as tabulated in Table 1, the machine was operated under the retention copy mode to examine the transfer performance and the extent to which the latent image was disturbed, both exhibited during the cyclic copying operations except for the initial copying operation, the result of which is shown in Table 1.

TABLE 1

| | Voltage Applied to Grid Electrode (Volt) | | | | | |
|---|---|---|---|---|---|---|
| | 0 | −300 | −600 | −900 | −1200 | −1500 |
| Transfer Performance | X | Δ | ○ | ○ | ○ | ○ |
| Latent Image Disturbance | ○ | ○ | ○ | Δ | X | X |

In this Table 1 as well as the other tables employed in this specification, the symbols used in the respective entries represent the following:

Transfer Performance

X: No transfer takes place.
Δ: Thin characters transferred.
○: Thin and thick characters transferred.
○ : Solid image transferred.

Latent Image Disturbance

XX: Great (Pattern of discharge showed up clearly).
X: Medium (Background totally fogged).
Δ: Small (Background partially fogged).
○ : No disturbance.

Comparison 1

Using a copying machine similar to that in Example 1 excepting that the transfer charger was employed in the form of a DC corona charger and the separation of the copying paper from the drum was forcibly carried out by a belt system, a similar experiment was carried out under the identical conditions as in Example 1, for the purpose of comparison, the result of which is tabulated in Table 2.

Comparison 2

Using a copying machine similar to that in Example 1 excepting that the transfer charger was employed in the form of a DC corona charger and an AC charge eraser with applied voltage of 5.5 kVrms was employed for effecting the separation of the copying paper from the drum, a similar experiment was carried out under the identical conditions, as in Example 1, for the purpose of comparison, the result of which is tabulated in Table 2.

TABLE 2

| | | Voltage Applied to Transfer Charger (Volt) | | | | |
|---|---|---|---|---|---|---|
| | | 3 | 4 | 5 | 6 | 7 |
| Comp. 1 | Transfer Performance | X | Δ | ○ | ◎ | ◎ |
| | Latent Image Disturbance | ○ | X | XX | XX | XX |
| Comp. 2 | Transfer Performance | X | Δ | ○ | ◎ | ◎ |
| | Latent Image Disturbance | ○ | ○ | X | X | XX |

As Tables 1 and 2 make it clear, the possibility of the latent image being disturbed by the separation discharge is smaller in the case where the AC SCOROTORON charger was employed for the DC transfer charger than in the case where the DC corona charger was employed for the same. This appears to have resulted from the following reason.

As an air gap created between the copying paper and the photoconductive layer during the separation of the copying paper from the drum increases progressively, the static capacitance therebetween abruptly drops. However, since the density of electric charge on the copying paper remains constant, the abrupt decrease of the static capacitance is accompanied by a corresponding increase in potential difference therebetween. On the other hand, the AC SCOROTORON charger functions to restrict the charge potential to a value approximating to the voltage applied to the grid electrodes and, therefore, if the voltage to be applied to the grid electrodes is set to be a value approximating the potential of the electrostatic latent image, an electric current opposite in polarity to the discharge occurring at the starting point of separation of the copying paper from the drum surface will flow, suppressing the generation of the separation discharge.

Figure 2:
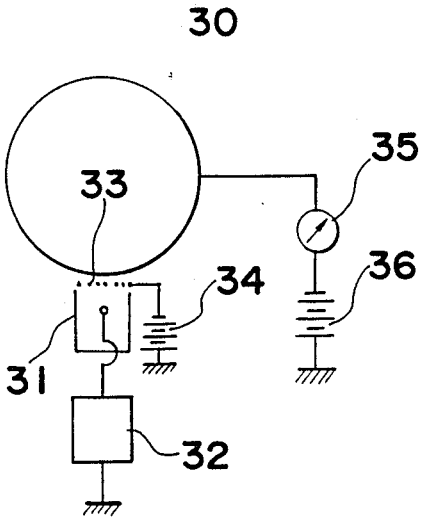
FIG. 2 is a schematic diagram showing an experimental model used to explain the principle of the present invention.

The above described reasoning may well be understood from the following simulated experiment which will now be described with reference to FIG. 2.

The electric current flowing through an aluminum tube 30, when a voltage was applied to the aluminum tube 30 by a SCOROTORON charger 31 connected with a high voltage transformer 32 and, on the other hand, a voltage from a DC power source 34 was applied to grid electrodes 33, was measured by the use of a DC ammeter 35 connected in series with the aluminum tube 30 and a bias voltage source 36. The bias voltage applied to the aluminum tube 30 from the bias voltage source 36 analogically represents the surface potential built up on the rear surface of the copying paper.

Figure 3:
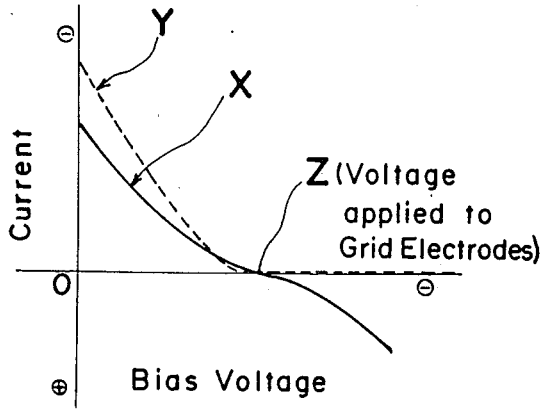
FIG. 3 is a graph showing the change in current measured in the model of FIG. 2.

FIG. 3 illustrates the result of the simulated experiment, wherein the axis of abscissas represents the bias voltage applied to the aluminum tube 30 and the axis of ordinates represents the current flowing through the aluminum tube 30. In the graph of FIG. 3, a solid line curve X represents the change in current exhibited when the AC voltage was applied to the SCOROTORON charger 31, and it will readily be seen that, when the applied AC voltage became higher than the voltage applied to the grid electrodes, the current of the opposite polarity flowed. In other words, when the potential difference between the copying paper and the photoconductive layer at the time of separation of the former from the latter is higher than the voltage applied to the grid electrodes, the current of opposite polarity flows removing the charge on the copying paper thereby to suppress the potential difference therebetween. In this way, the generation of the separation discharge can be prevented.

On the other hand, a broken line curve Y represents the change in current exhibited when the DC voltage was applied to the SCOROTORON charger 31, and it will be seen that, even when the applied DC voltage became higher than the voltage applied to the grid electrodes, no current of opposite polarity flowed at all. This accounts for the fact that no generation of the separation discharge can be prevented.

EXAMPLE 2

Figure 4:
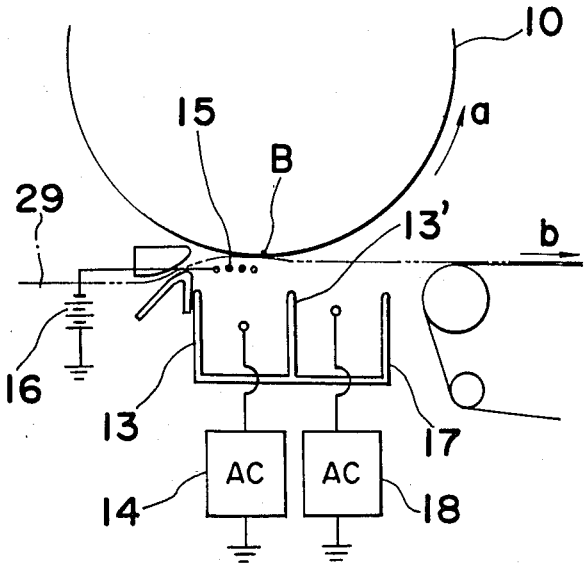
FIGS. 4 to 7 are schematic diagrams similar to FIG. 1 showing second to seventh preferred embodiments of the present invention.

Using a copying machine similar to that in Example 1 excepting that the transfer charger 13 was employed in the form of an AC SCOROTORON charger and some of the grid electrodes 15 adjacent the starting point B of separation were eliminated as shown in FIG. 4, a similar experiment was conducted under the same conditions as in Example 1, the result of which is tabulated in Table 3.

In this Example, at a position where some of the grid electrodes 15 have been eliminated, it functions as a charge erasing charger, and, by adjusting the right-hand position, as viewed in FIG. 4, of the grid electrodes, the respective positions at which the transfer charger and the AC charge eraser act can be more accurately controlled than by adjusting the position of a stabilizer plate 13'.

TABLE 3

| | Voltage Applied to Grid Electrode (Volt) | | | | | |
|---|---|---|---|---|---|---|
| | 0 | −300 | −600 | −900 | −1200 | −1500 |
| Transfer Performance | X | Δ | ○ | ○ | ○ | ◎ |
| Latent Image Disturbance | ○ | ○ | ○ | ○ | ○ | ○ |

EXAMPLE 3

Figure 5:
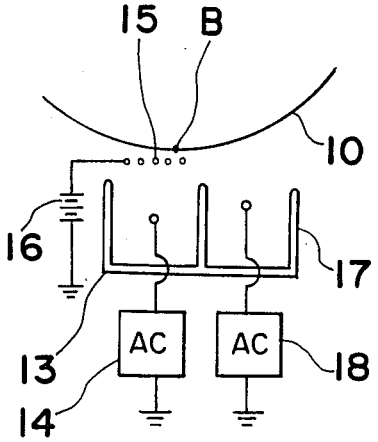

Using a copying machine similar to that in Example 1 excepting that, as shown in FIG. 5, the grid electrodes 15 were extended to a position on one side of the separation starting point B adjacent the conveyance system for the transportation of the copying paper towards the fixing station, a similar experiment was conducted under the same conditions as in Example 1, the result of which is tabulated in Table 4. This Example may be considered a version intermediate between Examples 1 and 2.

TABLE 4

| | Voltage Applied to Grid Electrode (Volt) | | | | | |
|---|---|---|---|---|---|---|
| | 0 | −300 | −600 | −900 | −1200 | −1500 |
| Transfer Performance | X | Δ | ○ | ○ | ○ | ◎ |
| Latent Image Disturbance | ○ | ○ | ⊙ | ○ | Δ | X |

EXAMPLE 4

Figure 6:
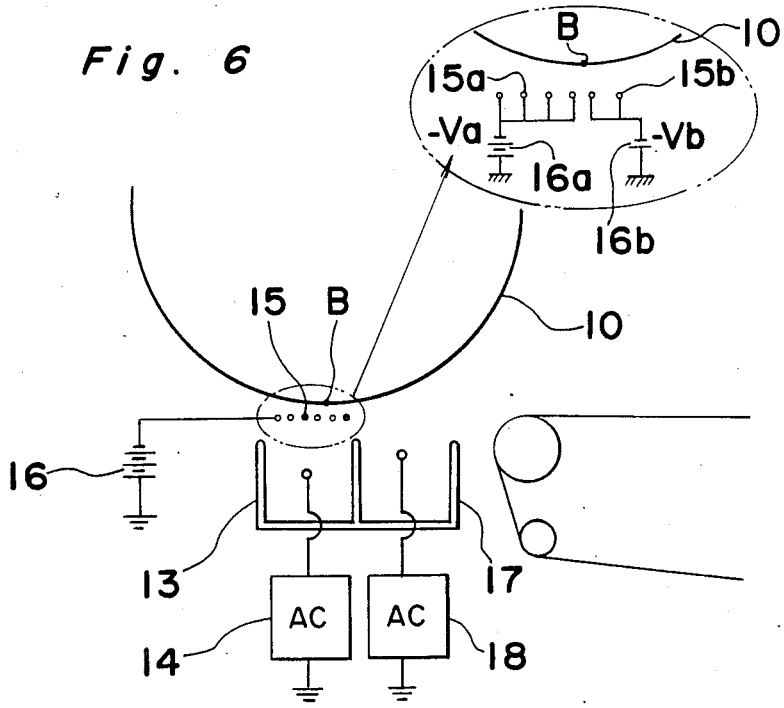

A similar experiment was conducted under the same conditions as in Experiment 1. However, a copying machine used for the purpose of this Example was similar to that in Example 1, but different therefrom in that, as shown in FIG. 6, the grid electrodes were divided into two groups; the electrode group 15*a* and the electrode group 15*b* being positioned on respective sides of the separation starting point B adjacent the paper supply side and the belt conveyance system, respectively, and electrically connected respectively with separate DC power sources 16*a* and 16*b*. The DC power sources 16*a* and 16*b* differed from each other in that the voltage −Vb of the DC power source 16*b* was displaced from the voltage −Va of the DC power source 16*a* in a direction towards the opposite polarity. In other words, if the toner is charged to a positive polarity, and assuming that the voltage −Va is applied to the grid electrode group 15*a*, the generation of the separation discharge can be suppressed provided that a voltage on a positive side with respect to the voltage −Va (in the case of the negative, $|Va| > |Vb|$, or a positive voltage) is applied to the grid electrode group 15*b* which is within an area where the separation discharge is likely to occur. On the other hand, if the toner is charged to a negative polarity, and assuming that the voltage applied to the grid electrode group 15*a* is expressed by Va, the generation of the separation discharge can be likewise suppressed provided that a voltage on a negative side with respect to the voltage Va (in the case of the positive, $|Va| > |Vb|$, or a negative voltage) is applied to the grid electrode group 15*b*.

It is to be noted that, in carrying out the experiment for the purpose of this Example, the voltage Va was fixed at 1.5 kV while the voltage Vb was varied as tabulated in Table 5 showing the result of the experiment.

TABLE 5

| | Voltage Vb Applied to Electrode Group (kV) | | | | |
|---|---|---|---|---|---|
| | −1.5 | −0.5 | 0 | +0.5 | +1.5 |
| Latent Image Disturbance | X | Δ | ○ | ○ | ○ |

EXAMPLE 5

Figure 7:
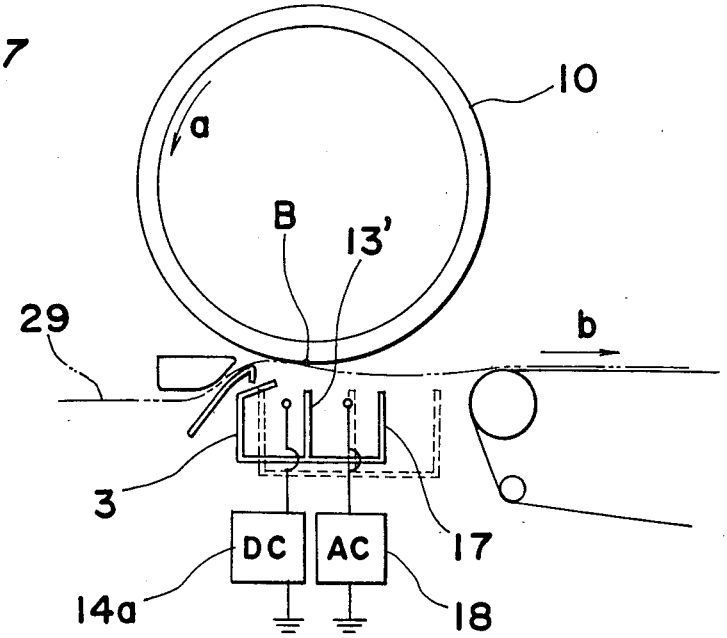

In carrying out an experiment, similar to Example 1, under the same conditions as in Example 1, the use was made of a copying machine similar to that in Example 1, but differing therefrom in that, as shown in FIG. 7, the transfer charger 13 was employed of a type provided with a DC high voltage transformer 14*a* and that both the transfer charger 13 and the AC charge eraser 17 were displaced in position in a direction towards the paper supply side from the position shown by the phantom line at which they were positioned according to the prior art or any one of the foregoing Examples, so that the stabilizer plate 13' could be positioned immediately beneath the separation starting point B.

Although the DC high voltage transformer used in the machine employed in this Example is less costly than the AC high voltage transformer, no generation of the separation discharge can be effectively prevented if the transfer charger and the AC charge eraser are positioned as shown by the phantom line as hereinbefore discussed in connection with the prior art. Therefore, in this Example, the stabilizer plate 13' partitioning the DC transfer charger 13 of DC type and the AC charge eraser 17 from each other is successfully so positioned immediately beneath the separation starting point B as to cause the AC charge eraser 17 to extend its charge erasing action to the separation starting point, thereby suppressing the generation of the separation discharge.

In carrying out the experiment for this Example, both the outputs of the transfer charger 13 and the charge eraser 17 were varied as tabulated in Table 6 showing the result of the experiment.

TABLE 6

| Transfer Charger Output (kV) | Charge Eraser Output | | | | | | | |
|---|---|---|---|---|---|---|---|---|
| | 5.5 kVrms, Bias 0 Volt | | | | 5.5 kVrms, Bias +1 kV | | | |
| | 5.0 | 5.5 | 6.0 | 6.5 | 5.0 | 5.5 | 6.0 | 6.5 |
| Transfer Performance | ○ | ○ | ⊙ | ◎ | Δ | ○ | ◎ | ◎ |
| Latent Image Disturbance | Δ | ○ | Δ | X | ○ | ○ | ○ | Δ |

Figure 8:
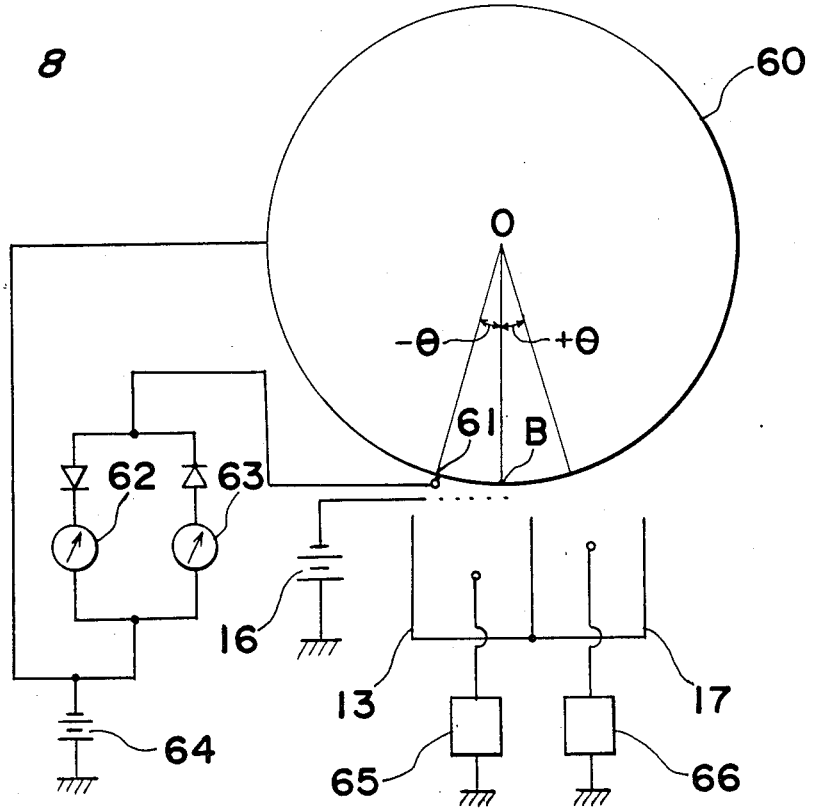
FIG. 8 is a schematic diagram showing a measuring apparatus used to obtain test results for the purpose of comparison of the present invention with the prior art.
Figure 9A:
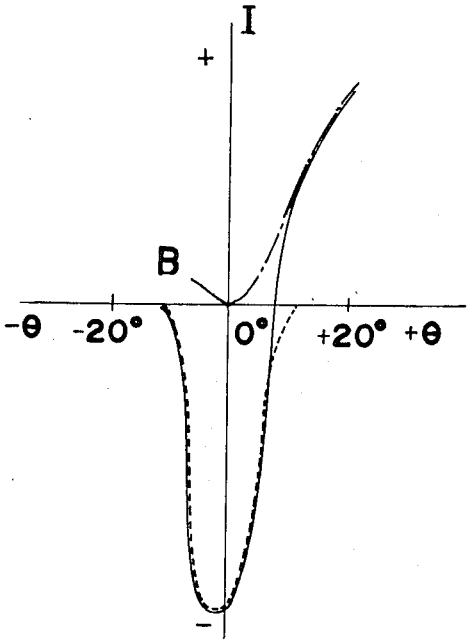
FIGS. 9(*a*) to 9(*f*) are graphs showing characteristic curves measured with the use of the apparatus shown in FIG. 8.
Figure 9B:
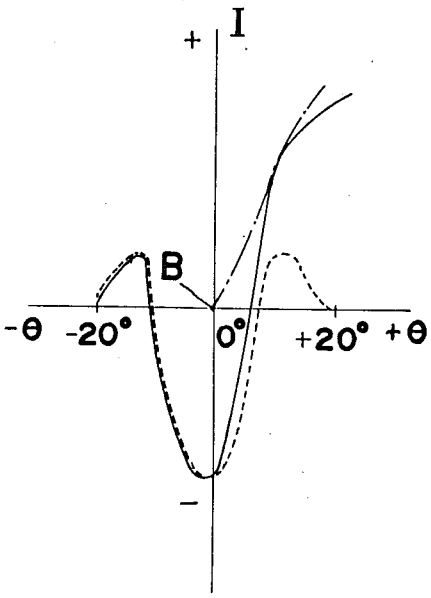
Figure 9C:
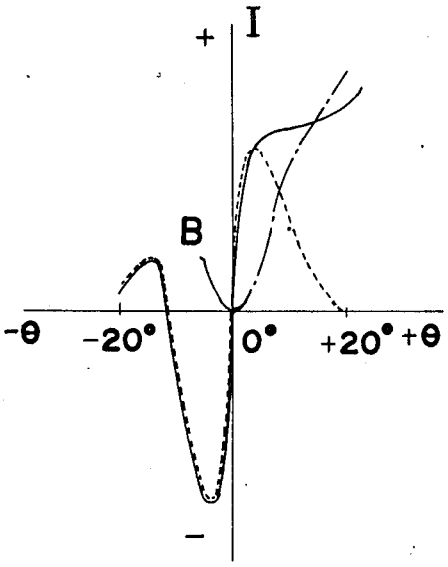
Figure 9D:
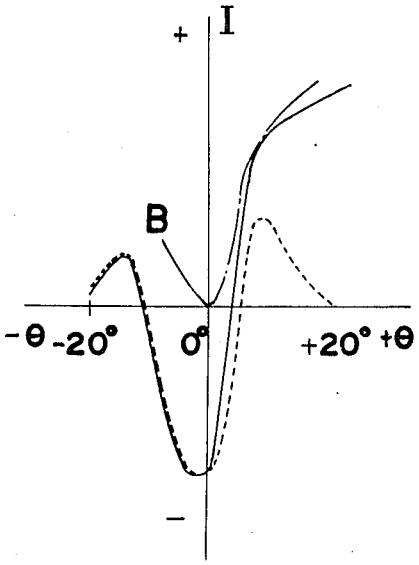
Figure 9E:
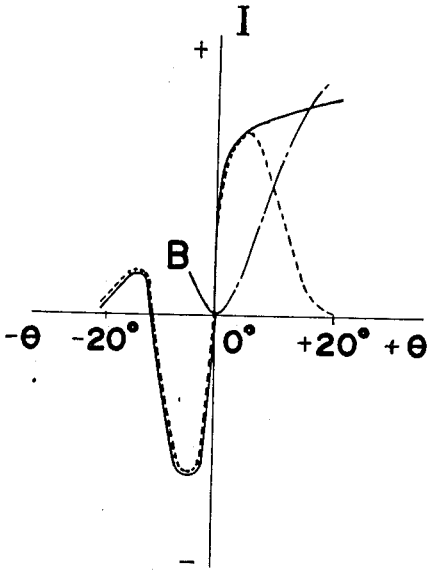
Figure 9F:
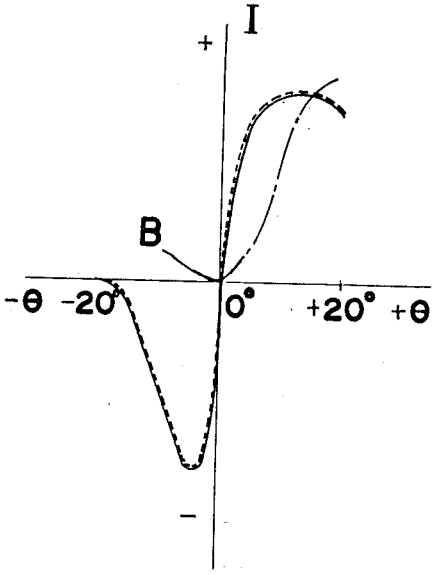
Figure 10:
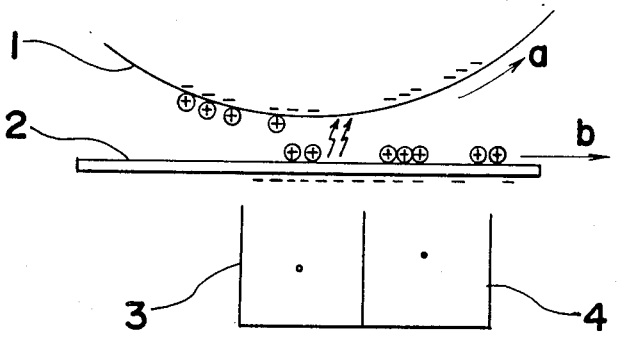
Fig. 10 PRIOR ART
FIG. 10 is a schematic diagram showing the relationship in position between the photoconductive medium and the copying paper in the prior art electrophotographic copying machine.

With the use of a measuring apparatus shown in FIG. 8, a series of experiments were conducted to determine a distribution of current during the separation relative to the angle of the photoreceptor drum, which is exhibited by the system according to any one of the foregoing embodiments of the present invention and the prior art system.

The measuring apparatus makes use of an aluminum tube 60 in place of the photoreceptor drum, and a measuring element for detecting corona ions and current applied by the transfer charger 13 and the separation charger 17. The current flowing through the measuring element 61 is divided by diodes into positive and negative components which are subsequently measured by respective ammeters 62 and 63. The measuring element 61 is composed of a tungsten wire of 100 μA arranged so as to extend in a direction parallel to the longitudinal axis of the aluminum tube spaced 100 μm therefrom. During the measurement, the aluminum tube is moved about its own longitudinal axis to vary the angle $\theta$ (i.e., $\theta = 0 \rightarrow$ Point B), so that the pattern of distribution of current can be measured.

A bias voltage source 64 analogously represents the surface potential of a copying paper and applies a bias voltage to both the aluminum tube 60 and the measuring element 61.

Reference numerals 65, 66 and 16 represent a high voltage power source for the transfer charger, a high voltage power source for the separation charger, and the bias power source of the grid electrodes.

With the use of the measuring apparatus of the construction described above, the positive and negative components ($I_+$ and $I_-$) of the current flowing through the wire at different positions relative to change in angle $\theta$ (±20°) was measured, the result of which is shown in FIGS. 9(*a*) to 9(*f*). In each of FIGS. 9(*a*) to 9(*f*), a curve shown by the dotted line represents a waveform of only the transfer charger, a curve shown by the single-dotted chain line represents a waveform of only the separation charger, and a curve shown by the solid line represents a composite waveform of a totalized version of both chargers.

The experimental conditions employed to obtain the results shown in FIGS. 9(*a*) to 9(*f*) are tabulated as follows.

| | Output of Transfer Charger | Output of Separat. Charger | Grid Bias | Nos. of Bias Wires | Nos. of Bias 64 | Result shown in |
|---|---|---|---|---|---|---|
| DC Transfer | DC | AC | — | — | −750 V | FIG. 9(a) |
| AC Separat. | 5 kV | 5.5 kVrms | | | | |
| Example 1 | ↑ | ↑ | −600 V | $^{6}$60 μm | ↑ | FIG. 9(b) |
| Example 2 | ↑ | ↑ | −1500 V | $^{4}$60 μm | ↑ | FIG. 9(c) |
| Example 3 | ↑ | ↑ | −900 V | $^{5}$60 μm | ↑ | FIG. 9(d) |
| Example 4 | ↑ | ↑ | Va = 1500 V<br>Vb = 0 V | 4 + 2<br>60 μm | ↑ | FIG. 9(e) |
| Example 5 | DC<br>5 kV | ↑ | — | — | ↑ | FIG. 9(f) |

Note: Data concerned of the Examples are the best ones.

In each of the graphs of FIGS. 9(*a*) to 9(*f*), the axis of abscissas represents the angle $\theta$ and the axis of ordinates represents a current I. $\theta=0$ means the starting point of separation, $\theta=-20°\sim0°$ means a transfer region, and $\theta=0°\sim+20°$ means a separation region.

Analysis of the Characteristic Graphs

1.

With respect to the waveform of the current produced by the SCOROTORON ACA transfer charger (see the dotted line curves in FIGS. 9(*b*) to 9(*e*)), a positive waveform in the transfer region has no transfer function, but a positive waveform in the separation region fulfills a charge erasing function. Accordingly, the greater the positive waveform in the separation region, the more facilitated the charge erasing function.

2.

With respect to the waveform of the current produced by the AC separation charger (see the single dotted line curve in FIG. 9(*a*)), it is short of a charge erasing component adjacent the starting point of separation at $\theta=0°$. Accordingly, the composite waveform in each of FIGS. 9(*a*), 9(*b*) and 9(*d*) exhibits a positive waveform from a position away from $\theta=0°$.

3.

As compared with the waveforms shown in FIGS. 9(*c*) and 9(*e*), the waveforms shown in FIGS. 9(*b*) and 9(*d*) are such that a charge erasing efficiency at the starting point of separation is low because a positive waveform is spaced from $\theta=0°$. In other words, the nearer the waveform to $\theta=0°$, the greater the AC charge erasing component at the starting point of separation.

4.

In Examples 4, 2 and 5, since the waveform extends through $\theta=0°$ as shown in FIGS. 9(*e*), 9(*c*) and 9(*f*), an AC charge erasing component acts at the starting point of separation to avoid the occurrence of the separation discharge, and therefore, no deterioration of the electrostatic latent image occurs.

5.

Even in the case where the waveform extends through $\theta=0°$, the greater the inclination of the waveform as shown in FIG. 9(*e*), (that is, the steeper the set-up of the waveform), the higher the charge erasing efficiency and, hence, the larger the range in which no deterioration of the electrostatic latent image occurs.

6.

Comparing the waveform in the Comparison shown in FIG. 9(*a*) with that in Example 5 shown in FIG. 9(*f*), it is clear that, when the stabilizer plate partitioning both chargers from each other is displaced to a position confronting the starting point of separation, the waveform extends through $\theta=0°$ to permit an AC charge erasing component of the AC separation charger to act at the starting point of separation thereby avoiding any possible deterioration of the electrostatic latent image.

7.

Comparing the waveforms in Examples 2 and 4 shown in FIGS. 9(*c*) and 9(*e*) with each other, it is clear that, if the grid electrodes of the SCOROTORON AC transfer charger are separated from grid electrodes in the transfer region rather than some of them adjacent the starting point of separation being omitted, and when the voltage applied to the grid electrodes confronting the starting point of separation is rendered 0 volt or in polarity opposite to that applied to the grid electrodes in the transfer region, the waveform at $\theta=0°$ favorably sets up and the AC charge erasing component at the starting point of separation can act efficiently.

8.

Comparing the waveforms in Examples 2 and 3 shown in FIGS. 9(*c*) and 9(*d*) with each other, it is clear that, when some of the grid electrodes of the SCOROTORON AC transfer charger which confront the starting point of separation are omitted, the amount of the AC charge erasing component at the starting point of separation can be increased with improved charge erasing efficiency.

9.

In view of Example 5, the waveforms in Examples 1 and 5 shown in FIGS. 9(*b*) and 9(*d*) can be made to extend through $\theta=0°$ when the stabilizer plate partitioning both chargers from each other is displaced in a direction towards the transfer region, and in such case, the AC charge erasing component can be produced from the starting point of separation.

10.

Although the waveform in Example 4 shown in FIG. 9(*e*) is obtained when the voltage Vb applied to some of the grid electrodes confronting the starting point of separation is zero, it appears that the set-up of the waveform will further increase, exhibiting a favorable waveform, if the voltage opposite in polarity, for example, +500 V or +1500 V is applied.

11.

The increase in the set-up of the waveform at $\theta=0°$, can also be accomplished by positioning only a corona wire of the AC separation charger adjacent the starting point of separation.

As hereinbefore discussed, for the purpose of the present invention, it is preferable to position the transfer and separation chargers at a position so adjacent the starting point of separation that the current waveform can extend through $\theta=0°$ with increased set-up thereof.

Although the present invention has fully been described in connection with the various illustrative examples with reference to the accompanying drawings, it is to be noted that various changes and modifications can be readily conceived by those skilled in the art without departing from the scope of the present invention as defined by the appended claims. By way of example, the photoconductive layer on the drum may not be charged to a negative polarity. Specifically, the CdS (VAB) photoconductive layer used in the practice of the present invention can be chargeable to both polarities and, therefore, similar experiments in which it was charged to a positive polarity, have exhibited respective results similar to those hereinbefore discussed.

Moreover, in the practice of the present invention, a separator for separating the copying paper from the photoconductive layer on the drum may be a combination of the AC charge eraser with any one of the belt type separator and the claw type separator.

Accordingly, such changes and modifications are to be understood as included within the true scope of the present invention.

What is claimed is:

1. An electrophotographic copying machine, comprising:

means for producing successively a plurality of identical copies from one electrostatic latent image formed on a photoreceptor medium; and transfer and separation chargers for imparting an AC charge erasing component to a point of start of separation of the copying paper from the photoconductive medium.

2. The machine as claimed in claim 1, wherein the transfer charger is a SCOROTORON AC charger wherein some grid electrodes confronting the starting point of separation are omitted.

3. The machine as claimed in claim 1, wherein the transfer charger is a SCOROTORON AC charger, and further comprising means for applying one polarity DC voltage to only some grid electrodes confronting the starting point of separation and applying the opposite polarity voltage to the others of the grid electrodes.

4. The machine as claimed in claim 1, wherein the transfer charger and the separation charger are in the form of a DC charger and an AC charge erasing charger, respectively, and further comprising a stabilizer plate positioned adjacent the starting point of separation for partitioning the transfer and separation chargers from each other.

5. A method for electrophotographic copying, comprising:

successively producing a plurality of identical copies from one electrostatic latent image formed on a photoreceptor medium; and imparting an AC charge erasing component to a point of start of separation of the copying paper from the photocopying medium by the use of transfer and separation chargers.

6. The method as claimed in claim 5, wherein the transfer charger is a SCOROTORON AC charger and some of the grid electrodes confronting the starting point of separation are omitted.

7. The method as claimed in claim 5, wherein the transfer charger is a SCOROTORON AC charger and further comprising the application of one polarity DC voltage to only some grid electrodes confronting the starting point of separation and applying the opposite polarity voltage to the others of the grid electrodes.

8. The method as claimed in claim 5, wherein the transfer charger and the separation charger are in the form of a DC charger an an AC charger, respectively, and further comprising positioning a stabilizer plate adjacent the starting point of separation for partitioning the transfer and separation chargers from each other.

* * * * *